United States Patent [19]

Dupraz

[11] Patent Number: 4,787,319

[45] Date of Patent: Nov. 29, 1988

[54] MODULAR FURNITURE FRAMEWORK

[76] Inventor: André Dupraz, 14, quai des Forces-Motrices, 1204 Geneva, Switzerland

[21] Appl. No.: 905,293

[22] Filed: Jul. 8, 1986

[30] Foreign Application Priority Data

Sep. 9, 1985 [CH] Switzerland ..... 03775/85

[51] Int. Cl.[4] ..... A47B 57/00

[52] U.S. Cl. ..... 108/64; 108/91; 211/182; 297/440; 403/297

[58] Field of Search ..... 297/421, 440; 403/297, 403/397; 108/64, 69, 66, 157, 91, 111; 211/182; 248/345.1

[56] References Cited

U.S. PATENT DOCUMENTS

| | | | |
|---|---|---|---|
| 1,018,636 | 2/1912 | Shults | 108/66 |
| 2,018,637 | 2/1912 | Shults | 211/182 |
| 2,645,509 | 7/1953 | Valenta | 403/297 |
| 3,157,136 | 11/1964 | Moody | 108/157 |
| 3,358,725 | 12/1967 | Bussard et al. | 248/345.1 |
| 4,117,783 | 10/1978 | Eckel et al. | 108/91 |
| 4,153,230 | 5/1979 | Giacin | 248/345.1 |
| 4,155,311 | 5/1979 | Jackovin | 108/91 |

FOREIGN PATENT DOCUMENTS

| | | | |
|---|---|---|---|
| 2230156 | 12/1974 | France | 108/64 |

*Primary Examiner*—Francis K. Zugel

*Attorney, Agent, or Firm*—Gifford, Groh, Sheridan, Sprinkle and Dolgorukov

[57] ABSTRACT

A framework for furniture is formed by an assembly of basic modular units or segments made each of a pair of arcuate tubes or rods disposed in a single plane and interconnected by radial tubes or rods. Feet extending perpendicular to the plane of the unit or segment can be connected to the corresponding feet of a second modular unit or segment disposed such as to form a mirror image of the first unit or segment.

8 Claims, 2 Drawing Sheets

FIG. 1
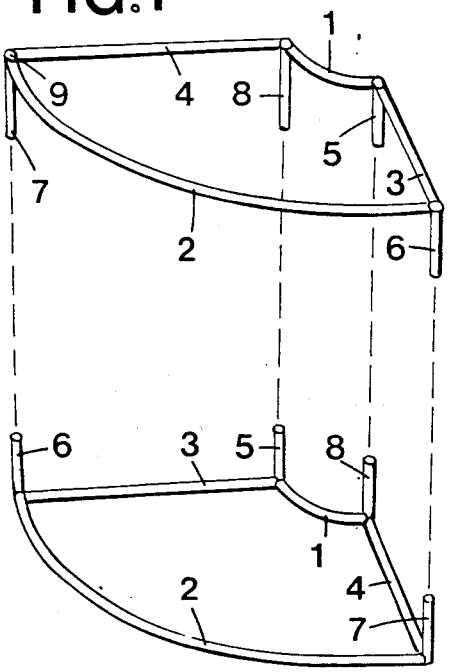
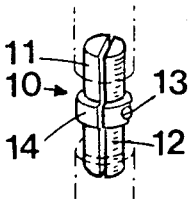
FIG. 1a
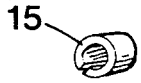
FIG. 1b
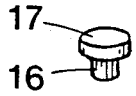
FIG. 1c
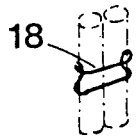
FIG. 1d
FIG. 2
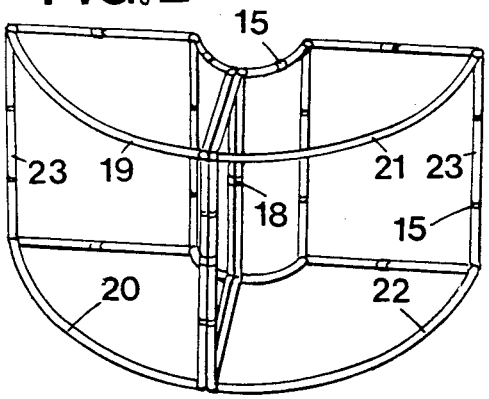
FIG. 3
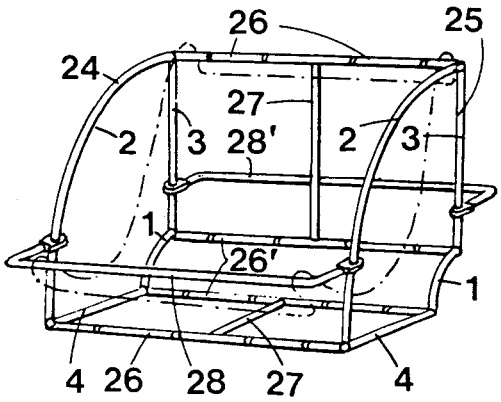
FIG. 4
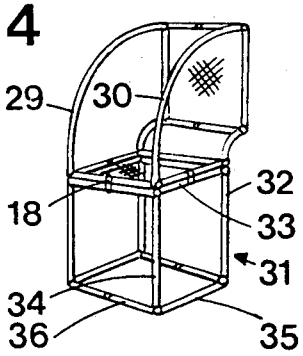

MODULAR FURNITURE FRAMEWORK

BACKGROUND OF THE INVENTION

The present invention relates to a furniture structure in general and more particularly to a modular structure for furniture comprising a basic framework that can be built up to a variety of uses and which is adapted to be combined with at least one member for supporting articles or a person.

SUMMARY OF THE INVENTION

The principal object of the invention is to provide a diversity of units of furniture all based upon a basic frame.

An object of the present invention is therefore to provide an article of furniture having a frame made of at least two tubes bent in the form of arcs of concentric circles disposed in a single plane and interconnected by tubes or rods extending radially in the plane to form a modular unit, the tubes extending radially being attached at their ends to a tube or rod extending perpendicularly to the plane and on the same side of the plane.

The many objects and advantages of the present invention will become apparent to those skilled in the art when the following description of the invention for erecting furniture in a modular fashion by starting from a basic unit is read in conjunction with the attached drawings wherein:

BRIEF DESCRIPTION OF THE DRAWINGS

FIG. 1 is a perspective view of a basic modular furniture unit or framework according to the invention;

FIGS. 1*a* through 1*d* illustrate diverse elements for use with the basic modular furniture unit or framework as shown at FIG. 1;

FIG. 2 illustrates a combination of basic modular units for providing a half-circular table;

FIG. 3 illustrates a framework for a low chair;

FIG. 4 illustrates a framework for a high chair;

DETAILED DESCRIPTION OF THE PREFERRED EMBODIMENT

Figure 5:
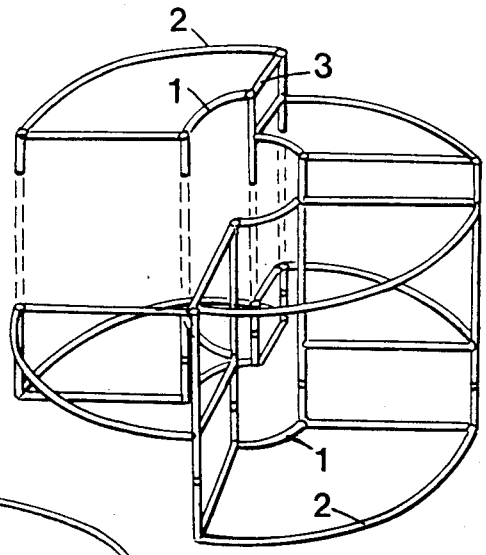
FIG. 5 illustrates a framework for a table etagere.

The unit of furniture illustrated at FIG. 1 comprises a pair of identical basic modular frame units, disposed such that one is a mirror image of the other, and adapted to be interconnected. The two basic frame units, or modular units, are each made of a pair of tubes 1 and 2 bent in the shape of an arc of a circle, the circles being concentric, disposed in a single plane and interconnected by a pair of straight tubes 3 and 4 disposed radially in that single plane for defining a modular unit in the geometric form of a sector of a circular ring extending over a quarter of a circle. The tubes 3 and 4 are attached at each of their ends to tubes designated 5, 6, 7 and 8, respectively, which extend perpendicularly from the plane on one side thereof and which define leg elements. The tubes 5 through 8 have an open end 9 on the other side of the plane.

FIG. 1*a* illustrates a connector 10 adapted to be inserted in the open end of the perpendicular tubes 5, 6, 7 and 8 to interconnect two opposed modular units (FIG. 1). The connector 10 is of a generally cylindrical shape and consists of two half-portions 11 and 12 which can be spread apart by means of a screw 13 which threads into the portion 12 and abuts against the portion 11. The screw 13 is disposed transversely through an enlarged diameter portion 14 defining an annular abutment on each of its sides.

FIG. 1*b* illustrates a slotted sleeve 15 in plastic such as polyvinyl, which is adapted to be snapped over the radially disposed and/or arcuate tubes forming the top portion of an item of furniture, such as to act as a support for a panel, more particularly a glass panel, placed upon the framework top portion. Because of the high co-efficient of friction of polyvinyl, more particularly with glass, the panels remain in position by gravity without any requirement of additional fastening means.

FIG. 1*c* illustrates a plug, comprising a body portion 16 and a head 17, the body portion 16 being adapted to be inserted in the open end of tubes such as tubes 5 through 8 of FIG. 1, the plug head 17 having a diameter larger than the inner diameter of the tubes such as to project beyond the end of the tube in which the plug is inserted. The plugs can also be used as support members for a glass panel or a laminated panel. When it is desired to achieve a better connection between the framework and a panel, a recess is formed at each corner of the panel for engagement over the head 17 of a plug.

FIG. 1*d* illustrates a spring connector 18 made by a bent spring steel wire. The connector 18 can be pressed upon a pair of tubes disposed side by side for interconnecting the tubes and obtaining a composite framework.

The half-circular table illustrated at FIG. 2 has a framework made of four basic unitary modular frame units, as shown at FIG. 1. The four modular frame units 19, 20, 21 and 22 are assembled two by two by means of vertical tubes 23 by way of connectors such as the connectors 10 of FIG. 1*a*. The legs of the basic modular frame units are held against each other by means of the spring wire connectors 18 of FIG. 1*d*. The plate or panel placed on the top of the framework may be in a single piece or in two pieces. It will be appreciated that four basic or modular frame units can be assembled in order to form a round table, the center of the panel disposed on the top of the framework being plain or provided with a central opening.

FIG. 3 illustrates an example of structure forming a low chair such as a sofa which is made up essentially of two frame modular units 24 and 25, each in the form of a quarter of a circular ring according to the structure of FIG. 1, disposed, vertically and interconnected by horizontal tubes 26 in turn interconnected by reinforcing tubes 27. A tube bent in a U-shape interconnects the outer arcuate tubes 2 of the frame modular units 24 and 25, allowing the lower edge of a length of canvas to be attached to the tube 28 while the upper edge of the length of canvas is attached to the upper horizontal tube 26. The length of canvas, shown in phantom lines, defines a seat in the same manner as a length of canvas defines the seat portion of a chaise lounge. A second length of tube 28', bent in a U-shape, is attached at its ends to the uprights defined by the radially disposed tubes 3 of the basic modular segments or units 24 and 25 such as to permit to tip the chair or sofa by supporting it from the ground by way of the tube 28' and of the two horizontal tubes 26' interconnecting the short arcuate tubes 1.

FIG. 4 illustrates a furniture framework according to the invention having two basic modular arcuate frame segments or units 29 and 30 interconnected one to the other and disposed on a support base 31 shaped as a parallelepiped. The support base 31 is made by assembling two complementary frame members, each comprising four tubes 32, 33, 34 and 35 interconnected in the form of a rectangle or square and having two sides of the same length as the radial tube of the basic modular units 29 and 30. The frame members have tubes 36 extending from each corner of the rectangle or square perpendicularly to and on the same side of the plane defined by the four tubes 32 through 35. The tubes 36 are interconnected end to end by means of the connector 10 of FIG. 1*a*. In a unit of furniture as illustrated at FIG. 4, the seat and the back are formed by panels attached directly to the tubular frames.

FIG. 5 illustrates an etagere. In such a structure, each modular unit is not situated in a common plane with an adjacent unit, which permits to attach the different portions of the framework by interconnecting axially the feet or extension tubes, all by means of the connectors 10 of FIG. 1*a*.

Figure 6:
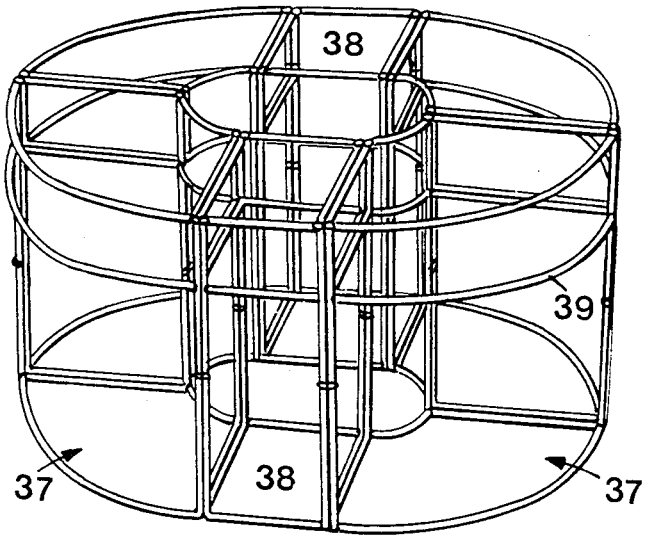
FIG. 6 illustrates a framework for a oval table.

FIG. 6 illustrates the framework for a table of generally oval shape which is obtained by interconnecting two half circular table units 37, identical to the table units of FIG. 2, by means of a pair of connecting elements 38 of parallelepipedonal shape, and of a height equal to that of the two half circular table frame units. In such a structure, the upper panel placed on top of the framework is preferably of a single piece and of overall dimensions wider than the overall dimensions of the supporting framework. Separate panels can be installed on the top of the portion 39 of the framework which is just below its top portion.

Figure 7:
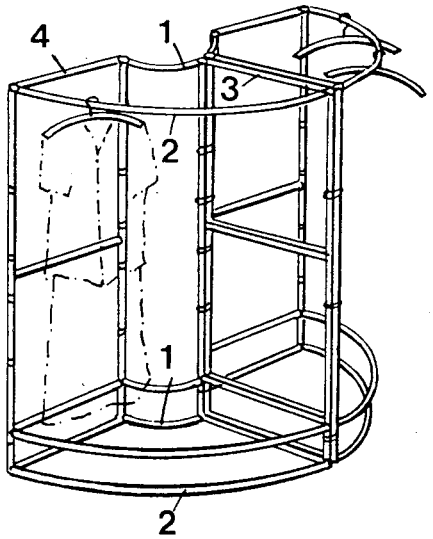
FIG. 7 is an illustration of a framework for a wardrobe hanger.

FIG. 7 illustrates an example of structure for hanging garments, for example, wherein the arcuate tubes at the top of the structure are conveniently disposed for supporting garment hangers.

It will be appreciated that many diverse shapes of structures could be erected by means of the basic modular units of the invention, and that the modular frame units are not necessarily made of tubes but could also be made of rods. The connecting members for interconnecting the diverse modular elements of the framework can be different from those illustrated at FIGS. 1*a* through 1*d*. In this regard, diverse connectors available on the market could be used.

Having thus described the present invention by way of examples of structures well designed to accomplish the objects of the invention, modifications whereof will be apparent to those skilled in the art, what is claimed as new is as follows:

1. A framework for furniture adapted to be combined with at least one element for supporting at least an article or a person, said framework being made of at least two basic modular units, each of said basic modular units comprising at least a pair of arcuate elongate members each shaped as an arc of a circle, said members being disposed parallel and concentric to each other in a single plane and interconnected by first straight elongate members extending radially in said plane, second elongate members extending perpendicular to said plane on a single side of said plane and solid with the ends of said first straight elongate members, so as to form a rigid modular unit, and said second elongate members extending perpendicular to said plane having both ends open so as to removably receive connectors for other elongate members from other modular units to form a rigid framework.

2. The framework of claim 1 wherein said elongate members are tubular members.

3. The framework of claim 1 wherein said modular unit extends substantially over a quarter of a circle.

4. The framework of claim 2 wherein said modular unit extends substantially over a quarter of a circle.

5. The framework of claim 1 wherein a pair of modular units are disposed side by side with said second elongate members perpendicular to said plane extending towards the second elongate members perpendicular to the plane of the other modular unit, said elongate members extending perpendicular being attached one by one at their ends.

6. The framework of claim 1 further comprising a complementary frame comprising four elongate members forming a rectangle and interconnecting elongate members each extending on one corner of each rectangle to an opposite corner.

7. A framework for furniture adapted to be combined with at least one element for supporting at least an article or a person, said framework being made of at least two basic modular units, said basic modular units comprising:

at least a pair of arcuate elongate members, said members being disposed parallel and concentric to one another in a single plane;

at least a pair of first straight elongate members, each having one end attached to one of said pair of arcuate elongate members and another end attached to another of said pair of arcuate elongate members, said first straight elongate members lying in said single plane;

at least four second straight elongate members extending from each of the ends of said pair of first straight elongate members, said second straight elongate members being rigidly fixed perpendicular to and on the same side of said single plane; and said second elongate member having both ends open so as to removably receive connectors for other elongate members from other modular units to form a rigid framework.

8. A framework for furniture adapted to be combined with at least one element for supporting at least an article or a person, said framework being made of at least two basic modular units, each of said basic modular units comprising at least a pair of arcuate elongate members each shaped as an arc of a circle, said members being disposed parallel and concentric to each other in a single plane and interconnected by first straight elongate members extending radially in said plane, second elongate members extending perpendicular to said plane on a single side of said plane and solid with the ends of said first straight elongate members, so as to form a rigid modular unit, said second elongate members extending perpendicular to said plane having open ends so as to be able to receive connectors for other elongate members from other modular units to form a rigid framework, and said connectors for said second elongate members being interconnectable cylindrical connectors selectively fittable at said open ends.

* * * * *